US007819606B2

(12) United States Patent
Obedzinski

(10) Patent No.: US 7,819,606 B2
(45) Date of Patent: Oct. 26, 2010

(54) PROTECTIVE APPARATUS FOR A ROADWAY MARKER

(76) Inventor: Mark Obedzinski, 1010 Sugar Mountain Way, Anmore, BC (CA) V3H 4Y7

( * ) Notice: Subject to any disclaimer, the term of this patent is extended or adjusted under 35 U.S.C. 154(b) by 0 days.

(21) Appl. No.: 12/430,378

(22) Filed: Apr. 27, 2009

(65) Prior Publication Data

US 2009/0238642 A1 Sep. 24, 2009

Related U.S. Application Data

(62) Division of application No. 11/490,132, filed on Jul. 21, 2006, now Pat. No. 7,524,137.

(51) Int. Cl.
*E01F 9/06* (2006.01)

(52) U.S. Cl. ..... 404/15; 404/12; 404/16

(58) Field of Classification Search ..... 404/12–16
See application file for complete search history.

(56) References Cited

U.S. PATENT DOCUMENTS 2,180,105 A * 11/1939 Farrell ..... 404/9
3,587,416 A 6/1971 Flanagan
3,975,108 A 8/1976 Suhr et al.
4,174,184 A 11/1979 Heenan
4,402,627 A 9/1983 Schwab et al.
4,618,281 A 10/1986 Ajemian
4,634,310 A 1/1987 Clarke
4,883,384 A 11/1989 Hedgewick
D327,230 S 6/1992 Hedgewick
5,513,924 A * 5/1996 Alghunaim ..... 404/14
6,102,612 A * 8/2000 Pricone et al. ..... 404/13
6,116,812 A 9/2000 Hedgewick
6,234,712 B1 * 5/2001 Flader et al. ..... 404/14
6,439,803 B1 * 8/2002 Lowe ..... 404/14

* cited by examiner

*Primary Examiner*—Raymond W Addie
(74) *Attorney, Agent, or Firm*—VanOphem & Vanophem, P.C.

(57) ABSTRACT

A side guard for a roadway marker comprising an elongated rail member having a top and a bottom. A rooting pin extending from the bottom of the rail member. The rooting pin having a laterally open recess.

15 Claims, 4 Drawing Sheets

PROTECTIVE APPARATUS FOR A ROADWAY MARKER

CROSS-REFERENCES TO RELATED APPLICATIONS

This application is a divisional application of Ser. No. 11/490,132 filed Jul. 21, 2006, now U.S. Pat. No. 7,524,137 B2, issued on Apr. 28, 2009.

BACKGROUND OF THE INVENTION

The present invention relates to a protective apparatus for a roadway marker, and in particular, to an anchoring means for a protective apparatus for a roadway marker.

Protective apparatuses for roadway markers may be secured to a road by simply applying an adhesive between a bottom surface of the protective apparatus and an upper surface of the road as disclosed in U.S. Pat. No. 4,618,281 to Ajemian. Alternately, the protective apparatus may be provided with an anchoring system in the form of a base member which is embedded in the road and anchors the protective apparatus to the road. Traditionally, the base members are downwardly depending arcuate ribs as disclosed in U.S. Pat. No. 3,587,416 to Flanagan, U.S. Pat. No. 4,174,184 to Heenan and U.S. Pat. No. 6,116,812 to Hedgewick. Arcuate slots corresponding to the arcuate curvature of the base members are cut into the road and filled with an adhesive. The base members are inserted into the slots and the strength of the adhesive serves to anchor the protective apparatus to the road.

The dependency on the strength of the adhesive leaves these traditional anchoring means exposed to failure. Any defects in terms of either the consistency of the adhesive itself or any defects in the application of the adhesive to the base member may result in an inadequately anchored protective apparatus. The occurrence of inadequately anchored protective apparatuses may lead to higher road-maintenance costs, as both the protective apparatuses and their associated roadway markers may be damaged. It follows that increased roadway marker damage results in poor lane differentiation and thus more dangerous roads, putting public safety at risk. There is therefore a need for a more effective anchoring means for securing protective apparatuses for roadway markers to the road.

SUMMARY OF THE INVENTION

According to the present invention there is provided a side guard for a roadway marker. The side guard comprises an elongate rail member having a top and a bottom. A rooting pin extends from the bottom of the rail member. The rooting pin has a laterally open recess.

According to another aspect of the invention there is provided a protective apparatus for a roadway marker on a road. The protective apparatus includes a pair of spaced-apart side guards flanking opposed sides of the roadway marker. Each said side guard comprises an elongate rail member having a top and a bottom. The top of the rail member is aligned slightly above a top of the roadway marker. A rooting pin extends from the bottom of the rail member into the road. The rooting pin has a laterally open recess.

According to a further aspect of the invention there is provided a method for anchoring a side guard for a roadway marker to a road wherein the side guard comprises a base member. The method includes the steps of: forming a laterally open recess on the base member; forming an aperture in the road to receive the base member; placing an adhesive in the aperture; inserting the base member into the aperture.

According to yet a further aspect of the invention there is provided a method for protecting a roadway marker. The method including the steps of: placing a pair of spaced-apart side guards on opposed sides of the roadway marker; providing a transverse groove on a top planar surface of the side guard, the transverse groove having a groove bottom substantially aligned with a top of the roadway marker; identifying when the top surface of the protective member becomes flush with the groove bottom; and replacing the side guard when the top surface of the protective member becomes flush with the groove bottom.

DETAILED DESCRIPTIONS OF THE PREFERRED EMBODIMENTS

Figure 1:
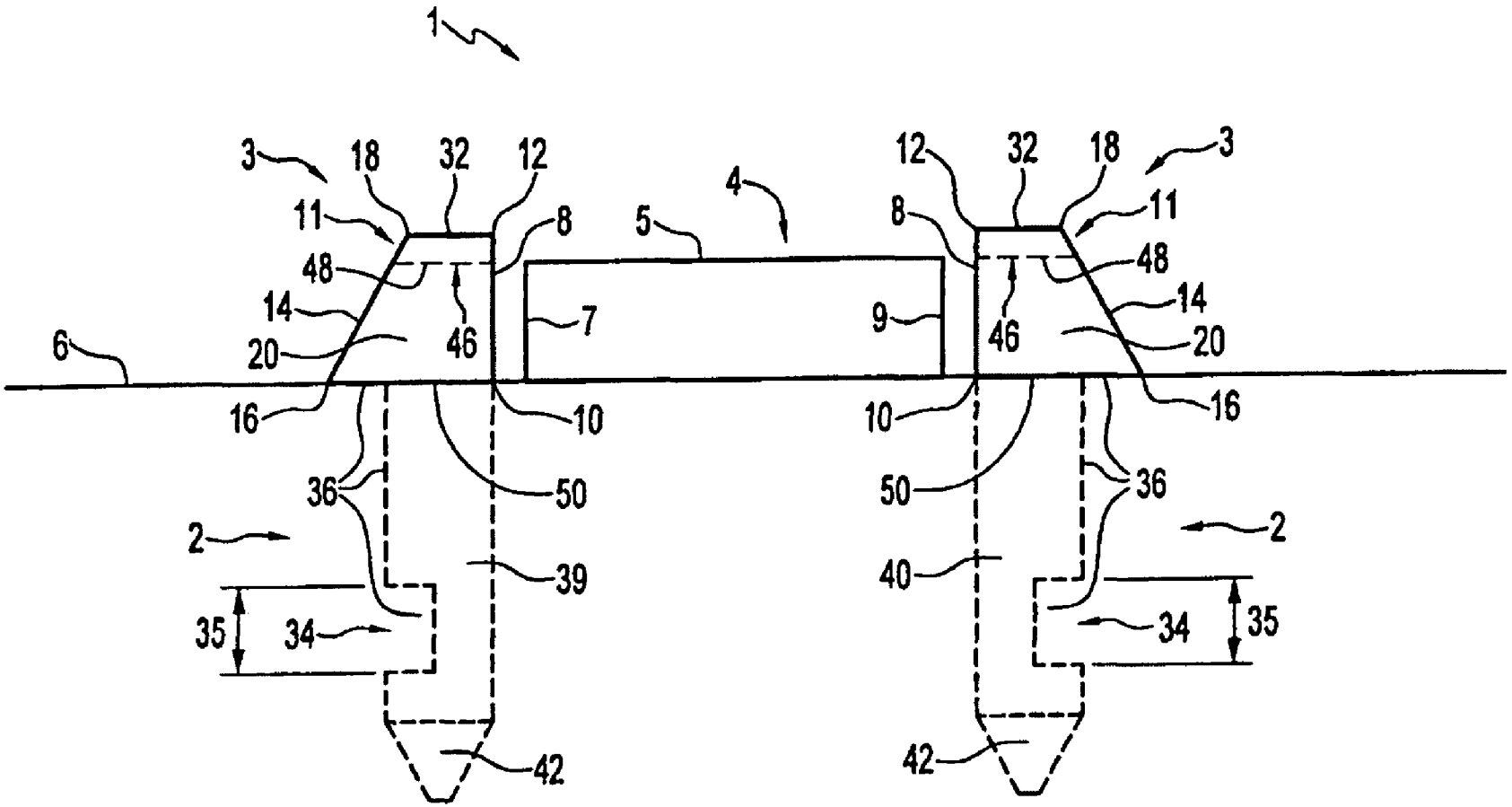
FIG. 1 is a front end view of a protective apparatus according to an embodiment of the invention showing the protective apparatus embedded in a road and flanking a roadway marker, portions below the road surface being shown in broken lines.

Referring to the drawings and first to FIG. 1, a protective apparatus according to an embodiment of the invention is shown indicated generally by reference numeral 1. The protective apparatus 1 is suitable for protecting a roadway marker 4 or other similar devices. In this embodiment of the invention, the protective member 1 comprises a pair of spaced-apart side guards 3. Each side guard 3 is wholly formed and forged as a single piece of steel in this example. A preferred type of steel for the construction of the side guards 3 is 4140 forged steel. However, it will be understood by those skilled in the art that a variety of materials may be used in the construction of the side guards 3, including various kinds of plastics, various kinds of ceramics, various kinds of metals, and other suitable materials. Furthermore, the side guards 3 may be assembled from separate pieces and different combinations of materials.

Figure 2:
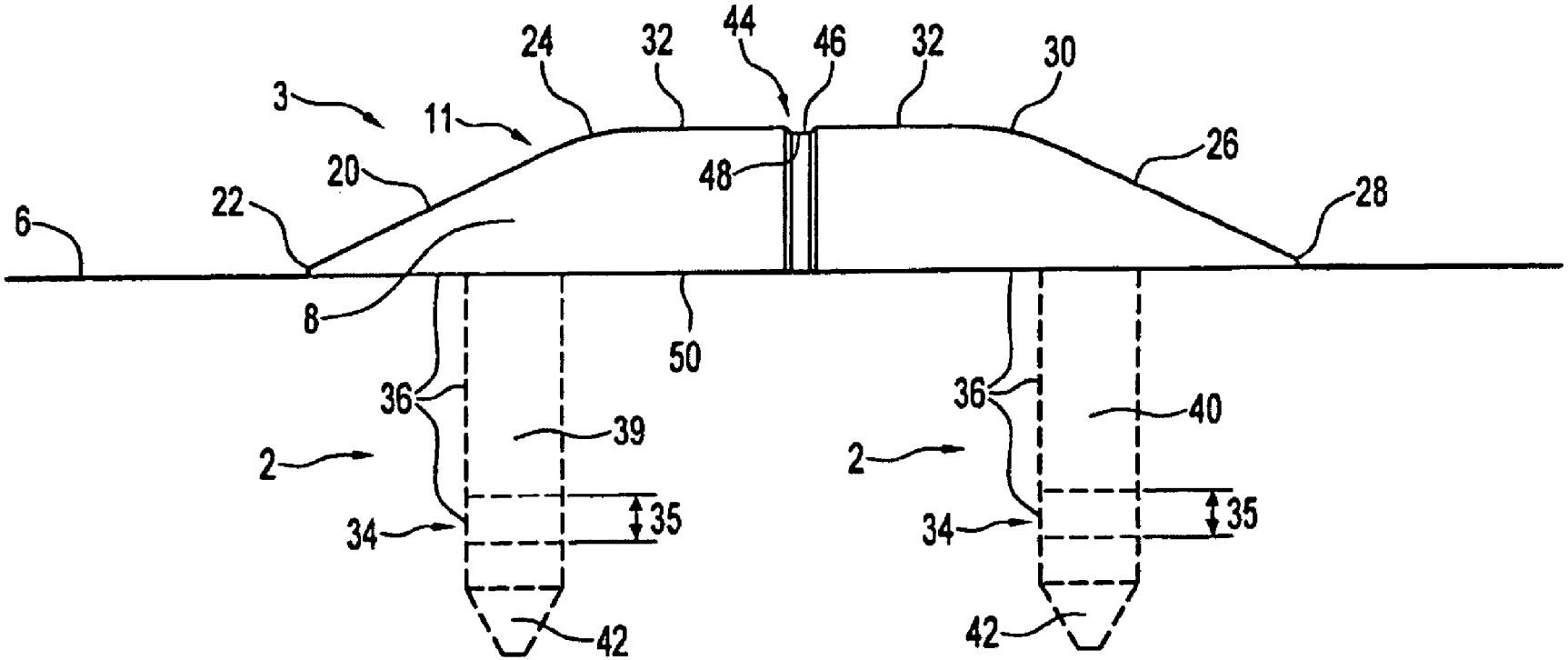
FIG. 2 is a side elevation view of a side guard of the protective apparatus of FIG. 1 showing the rail member embedded in the road, the portion below the road surface being shown in broken lines.

The side guards 3 flank opposed sides 7 and 9 of the roadway marker 4. Each side guard 3 has an elongate rail member 11. A first side of the rail member 11 defines an inner surface 8, with the inner surface 8 having a bottom 10 and a top 12. A second sloped side of the rail member 11 defines an outer ramp surface 14, with the outer ramp surface 14 having a bottom 16 and a top 18. The outer ramp surface 14 is opposed to the inner surface 8. Referring now to FIG. 2, each rail member 11 has sloped ends. A first sloped end defines a front ramp surface 20, with the front ramp surface 20 having a bottom 22 and a top 24. A second sloped end defines a rear ramp surface 26, with the rear ramp surface 26 having a bottom 28 and a top 30. It will be understood that the terms "inner" and "outer" are used in relation to the position of the inner surface 8 and the outer ramp surface 14 relative to the roadway marker 4, as shown in FIG. 1. It will be further understood that the terms "top", "bottom", "front" and "rear" are used in relation to the positions shown in FIGS. 1 and 2 when the side guard 3 is anchored to the road 6.

Figure 3:
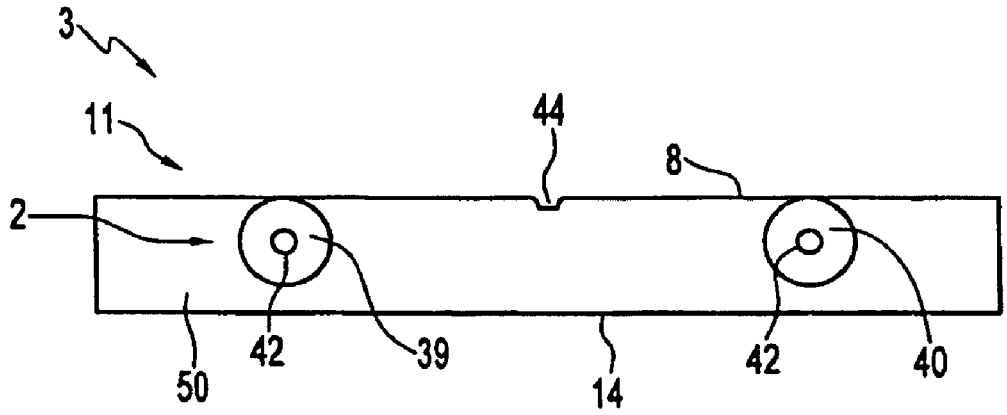
FIG. 3 is a bottom plan view of the side guard of FIG. 2.
Figure 4:
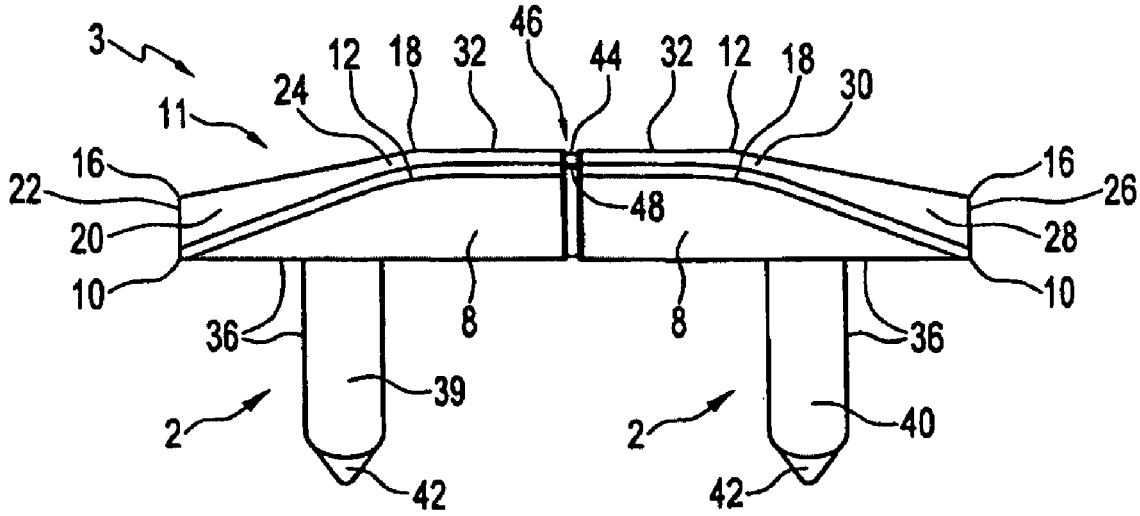
FIG. 4 is a side view of the side guard of FIG. 2.

Each rail member 11 also has a bottom 50, which is best shown in FIG. 3, and a top. In this embodiment of the invention, the top of the rail member is a substantially planar bridge surface 32, which is best shown in FIG. 4. The bridge surface 32 connects the tops 12, 18, 24 and 30 of the inner surface 8, the outer ramp surface 14, the front ramp surface 20, and the rear ramp surface 26 respectively. As best shown in FIG. 1, each bridge surface 32 is substantially parallel to a road 6 on which the protective apparatus is installed and each bridge surface 32 is aligned slightly above a top 5 of the roadway marker 4. As best shown in FIG. 2, there is also a center point 44 on each bridge surface 32. The front ramp surfaces 20 and rear ramp surfaces 26 are on opposite sides of their respective center points 44.

Each rail member 11 further has a transverse groove 46 along its respective bridge surface 32. In this embodiment of the invention, each transverse groove 46 is centered respective to its corresponding center point 44. However, it will be understood that such centering is not strictly necessary. Similarly, alternative embodiments of the invention may include a plurality of transverse grooves along the bridge surface. As best shown in FIG. 1, each transverse groove 46 has a groove bottom 48, and each groove bottom 48 aligns with the top 5 of the roadway marker 4. When the bridge surface 32 becomes substantially flush with the groove bottom 48, the side guard 3 needs replacing because the rail member 11 no longer allows a motorized vehicle such as a snow plow to clear the top 5 of the roadway marker 4. This occurs when the surface 32 wears to the groove bottom 48. Accordingly, the transverse groove 46 acts as a means for identifying when to replace the side guard 3.

Lying substantially along the road 6 are the bottoms 10, 16, 22, and 28 of the inner surface 8, the outer ramp surface 14, the front ramp surface 20, and the back ramp surface 26, respectively. In this embodiment of the invention, the bottom 50, which is best shown in FIG. 3, is a substantially planar surface that extends between the bottoms 10, 16, 22, and 28 of the inner surface 8, the outer ramp surface 14, the front ramp surface 20, and the back ramp surface 26, respectively. However, it will be understood by those skilled in the art that such a planar bottom surface is not strictly necessary for the invention. For example, in alternate embodiments of the invention the lower ends of the inner surface 8, the outer ramp surface 14, the front ramp surface 20 and the back ramp surface 26 may define a cavity or hollow interior at a base of the rail member.

Each said side guard 3 further includes a base member 2, shown in FIG. 1, which extends into the asphalt or other medium when the protective apparatus 1 is installed on the road. Each base member 2 in this embodiment of the invention extends downwardly from the bottom 50 of its corresponding rail member 11. However, each base member 2 could equally extend from elsewhere within the rail member 11. For example, in alternate embodiments of the invention, each rail member may comprise a hollow interior from which the base member extends. It will be further understood by those skilled in the art that the medium into which each base member extends may include but is not limited to asphalt, concrete, brick, or other suitable materials, used in the construction of surfaces which include but are not limited to roads, driveways, pathways, and sidewalks.

In the embodiment of the invention shown in FIGS. 1 to 5, each base member 2 comprises a pair of inset pins in the form of a first rooting pin 39 and a second rooting pin 40. In this embodiment of the invention, the rooting pins 39 and 40 are in the form of elongate cylinders. These provide the advantage of creating two anchoring points for each rail member 3 as exemplified by the two rooting pins 39 and 40. This doubles the anchoring force of the anchoring system compared to a single downwardly depending arcuate rib and allows for a more even distribution of forces on the road 6.

As best shown in FIG. 2, each of the rooting pins 39 and 40 is substantially perpendicular to the road 6 when the side guards 3 are installed. Each of the rooting pins 39 and 40 also has a tapered end 42 remote from the bottom 50 of the rail member 11. In this embodiment of the invention, each of the first rooting pins 39 is substantially aligned below the front ramp surface 20 of its corresponding rail member 11, and each of the second rooting pins 40 is substantially aligned below the back ramp surface 26 of its corresponding rail member 11.

Figure 5:
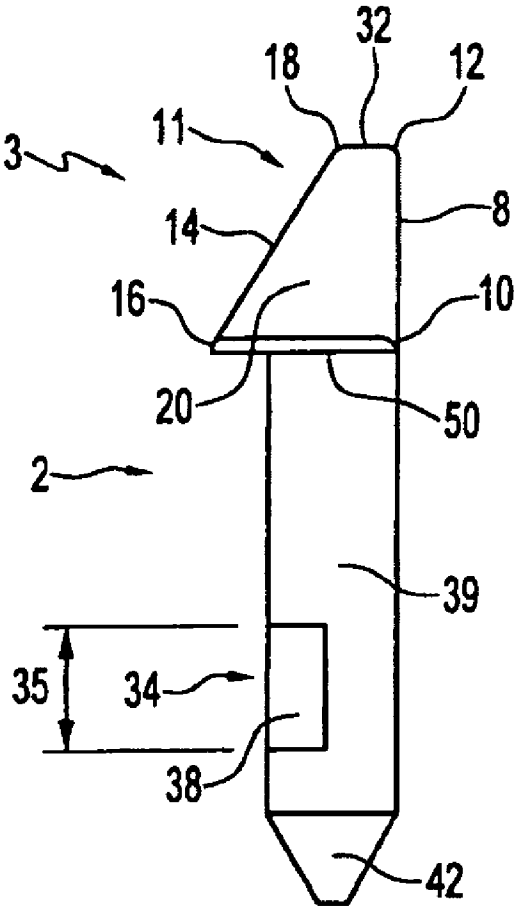
FIG. 5 is a front end view of the side guard of FIG. 2 showing a base member having a laterally open recess.

Each base member 2 further includes one or more laterally open recesses, or anchor recesses, as exemplified by recesses 34 in the first rooting pin 39 and the second rooting pin 40, as best shown in FIG. 1. In the embodiment of the invention shown in FIGS. 1 to 5, the recesses 34 are filled with an adhesive 36 when the protective member 1 is installed on the road 6. When the adhesive 36 cures it forms an anchor cushion 38, which is best shown in FIG. 5. The recess 34 further allows for the adhesive 36 formed anchor cushion 38 to key into the rooting pin 39 allowing for an adhesive shear point which restricts vertical movement of the rooting pin 39 when it is embedded in the road 6 as shown in FIGS. 1 and 2. It will be understood by those skilled in the art that a wide variety of adhesives may be used. In a preferred embodiment of the invention, the adhesive 36 is a resilient material, and in particular, an epoxy.

The protective apparatus 1 is installed by drilling a pair holes (not shown) into the road 6 adjacent opposed sides 7 and 9 of the roadway marker 6 and an adhesive is placed in the holes. In one example, 15 ml of the adhesive 36 is used. Each pair of holes receives the rooting pins 39 or 40 of one of the side guards 3. Prior to insertion of the rooting pins 39 and 40 into the holes, the rooting pins 39 and 40 and the bottom 50 of the rail member 11 are also coated with adhesive 36 to assist in securing the base member 2 and the bottom 50 of the rail member 11 to the road 6. Preferably, a layer of adhesive 1/16th of an inch thick coats the base member 2 and the base surface 50. In the present invention, the adhesive 36 acts as part of an anchoring means which secures the protective member to the road 6 as a seal to prevent water leakage and as a cushion to create an elastic adhesion between the side guard 3 and the road 6.

The procedure of drilling holes into the road allows for a quicker installation procedure as compared to the onerous prior art requirement of cutting arcuate slots. Furthermore, drilled holes have a greater structural strength than arcuate cut slots which enables the rooting pins 39 and 40, i.e. the base members 2, to positively anchor the protective apparatus 1 independently of the adhesive 36. The anchoring system is therefore comprised of both the positive anchoring of the protective member 1 to the road 6 by the base member 2, rooting pins 39 and 40, and the strength of the adhesive 36. As such, the strength of the adhesive does not provide the anchoring means, rather it increases the strength of the anchoring means. This differs significantly from prior art systems where only the strength of the adhesive is relied on for anchoring the protective members to the road.

Furthermore, the anchor cushion 38, shown in FIG. 5, absorbs shear forces and compression forces thereby acting to minimize the shear at the connection between the adhesive 36 and road 6. The adhesive 36 coating on the rooting pins 39 and 40 also acts as a cushion between the rooting pins 39 and 40 and the asphalt providing a bonding medium and flexing means when the road bed expands or contracts due to thermal conditions. The anchor cushion 38 acts as a shock absorber to allow for slight movement of the base member 2 when its corresponding rail member 11 is impacted by, for example, a motorized vehicle such as a snow plow. There will be limited breakage in the connection between the adhesive 36 and the road 6, so long as the anchor cushion 38 is capable of absorbing the various shear forces and compression forces. The anchor cushion 38 also allows for a greater area of shear in the adhesive 36. The recesses 34 and corresponding anchor cushions 38 are located near the tapered ends 42 of the rooting pins 39 and 40 to place the area of shear in the road 6 where bond strength is required. It will be understood by those skilled in the art that an increase in anchoring strength may be achieved by increasing the thickness 35 of the anchor recess 34 and hence corresponding anchor cushion 38, which thereby increases the area of shear in the adhesive.

Prior art designs do not include laterally open recesses and thus do not have such anchor cushions. As a result, prior art designs must depend primarily or exclusively on the strength of the connection between the adhesive and road, i.e. the strength of the adhesive, to anchor the protective member to the road. Accordingly, the structural aspects of the present invention ensure that, unlike the prior art, the present invention does not primarily depend on the strength of the adhesive to maintain the base member 2 in place and by extension to anchor the protective apparatus 1 to the road. It will further be understood by those skilled in the art that the shape of the base members 2 is not overly critical, so long as each of the base members 2 includes one or more laterally open recesses 34.

Figure 6:
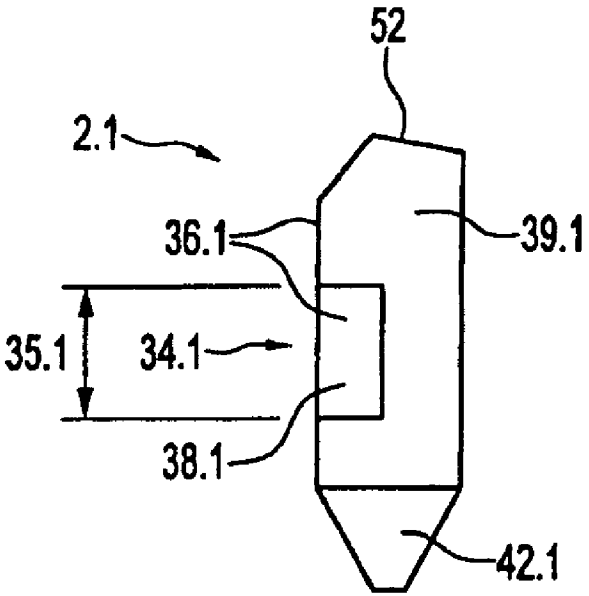
FIG. 6 is a front end view of a base member having a laterally open recess according to another embodiment of the invention.

Referring now to FIG. 6, another embodiment of the invention is shown wherein like parts have like reference numerals with the additional numerical designation "0.1". In the embodiment of FIG. 6, the invention solely comprises the base member 2.1. The base member 2.1 similarly has a laterally open recess 34.1 which is filled with an adhesive 36.1 to thereby create an anchor cushion 38.1. The rest of the base member 2.1 is also covered with the adhesive 36.1. The base member 2.1 comprises a rooting pin 39.1. There is also a connection end 52 for connecting the base member 2.1 to a device (not shown) which one desires to anchor. For example, the base member 2.1 may be connected to an existing or alternative protective member. The connection between the device to be anchored and base member 2.1 may take place through a number of different means including but not limited to: welding, gluing, bolting, or other suitable means, as are known to those skilled in the art.

It will be further understood by those skilled in the art that many of the details provided above are by way of example only and are not intended to limit the scope of the invention which is to be determined with reference to the following claims.

What is claimed is:

1. A side guard for a roadway marker, said side guard comprising:

an elongated rail member having:

a top having a planar surface portion; and a bottom;

at least one rooting pin extending from said bottom of said elongated rail member, said at least one rooting pin having a laterally open recess; and means for indicating wear of said planar surface portion, said wear indicator means comprising a transverse groove in said planar surface portion, said transverse groove having a groove bottom.

2. The side guard as claimed in claim 1, wherein said at least one rooting pin is an elongated cylinder.

3. The side guard as claimed in claim 1, wherein said at least one rooting pin has a tapered end remote from said bottom of said rail member.

4. The side guard as claimed in claim 1, wherein said rail member has sloped ends.

5. The side guard as claimed in claim 4, wherein a first of said at least one rooting pin is near a first sloped end of said rail member and a second of said at least one rooting pin is near a second sloped end of said elongated rail member.

6. The side guard as claimed in claim 1, wherein said elongated rail member has at least one sloped side.

7. A protective apparatus for a roadway marker on a road, said protective apparatus including a pair of spaced-apart side guards flanking opposed sides of said roadway marker, each said side guard comprising:

an elongated rail member having:

a top having a planar surface portion; and a bottom;

said top of said elongated rail member being aligned above a top of said roadway marker;

at least one rooting pin extending from said bottom of said elongated rail member into said road, said at least one rooting pin having a laterally open recess; and means for indicating wear of said planar surface portion of said top, said wear indicator means comprising a transverse groove in said planar surface portion, said transverse groove having a groove bottom terminating slightly above said roadway marker.

8. The protective member as claimed in claim 7, wherein said at least one rooting pin is coated with an adhesive and said recess is filled with said adhesive.

9. The protective member as claimed in claim 8, wherein said adhesive is a resilient material.

10. The protective member as claimed in claim 8, wherein said adhesive is an epoxy.

11. The side guard as claimed in claim 7, wherein said at least one rooting pin is in the form of an elongated cylinder.

12. The side guard as claimed in claim 7, wherein said at least one rooting pin has a tapered end remote from said bottom of said elongated rail member.

13. The side guard as claimed in claim 7, wherein said elongated rail member has sloped ends.

14. The side guard as claimed in claim 13, wherein a first rooting pin is near a first sloped end of said elongated rail member and a second rooting pin is near a second sloped end of said elongated rail member.

15. The side guard as claimed in claim 7, wherein said elongated rail member has at least one sloped side.

* * * * *